United States Patent [19]

Spendel

[11] Patent Number: 4,940,513

[45] Date of Patent: Jul. 10, 1990

[54] PROCESS FOR PREPARING SOFT TISSUE PAPER TREATED WITH NONCATIONIC SURFACTANT

[75] Inventor: Wolfgang U. Spendel, Cincinnati, Ohio

[73] Assignee: The Procter & Gamble Company, Cincinnati, Ohio

[21] Appl. No.: 280,086

[22] Filed: Dec. 5, 1988

[51] Int. Cl.[5] ..... D21H 23/26; D21H 25/04

[52] U.S. Cl. ..... 162/112; 162/158; 162/179; 162/184

[58] Field of Search ..... 162/111, 112, 158, 179, 162/182, 100, 184, 186, 175

[56] References Cited

U.S. PATENT DOCUMENTS

| | | | |
|---|---|---|---|
| 2,778,749 | 1/1957 | Bainbridge et al. | 162/158 |
| 2,944,931 | 7/1960 | Yang | 162/179 |
| 3,014,832 | 12/1961 | Donnelly | 162/184 |
| 3,301,746 | 4/1964 | Sanford et al. | 162/113 |
| 3,755,220 | 8/1973 | Freimark et al. | 260/17.3 |
| 3,812,000 | 5/1974 | Salvucci, Jr. et al. | 162/111 |
| 3,821,068 | 6/1974 | Shaw | 162/111 |
| 3,844,880 | 10/1974 | Meisel, Jr. et al. | 162/169 |
| 3,974,025 | 8/1976 | Ayers | 162/113 |
| 3,994,771 | 11/1976 | Morgan, Jr. et al. | 162/113 |
| 4,158,594 | 6/1968 | Becker et al. | 162/112 |
| 4,191,609 | 3/1980 | Trokhan | 162/113 |
| 4,300,981 | 11/1981 | Carstens | 162/109 |
| 4,372,815 | 2/1983 | Newkirk et al. | 162/158 |
| 4,447,294 | 5/1984 | Osborn | 162/158 |
| 4,632,730 | 12/1986 | Ulubay et al. | 162/111 |
| 4,637,859 | 1/1987 | Trokhan | 162/109 |
| 4,655,877 | 4/1987 | Horimoto et al. | 162/158 |
| 4,795,530 | 1/1989 | Soerens et al. | 162/111 |

FOREIGN PATENT DOCUMENTS

| | | | |
|---|---|---|---|
| 655032 | 1/1963 | Canada | 162/179 |

OTHER PUBLICATIONS

"Applications of Armak Quaternary Ammonium Salts", Bulletin 76–17, Armak Co., (1977).

*Primary Examiner*—Peter Chin

*Attorney, Agent, or Firm*—Bart S. Hersko; Thomas J. Slone; Fredrick H. Braun

[57] ABSTRACT

Disclosed is a process for making soft tissue paper which includes the steps of wet-laying cellulose fibers to form a web, applying to the wet web, at a fiber consistency level of from about 10% to about 80%, a noncationic surfactant, and then drying and creping the web to form the finished tissue paper. The process may further include the steps of applying an effective quantity of a binder material, such as starch, to the wet web for linting control, and to contribute tensile strength to the tissue paper.

17 Claims, No Drawings

PROCESS FOR PREPARING SOFT TISSUE PAPER TREATED WITH NONCATIONIC SURFACTANT

TECHNICAL FIELD

This invention relates, in general, to a process for preparing tissue paper; and more specifically, to a process for preparing high bulk tissue paper having an enhanced tactile sense of softness.

BACKGROUND OF THE INVENTION

Soft tissue paper is generally preferred for disposable paper towels, and facial and toilet tissues. However, known methods and means for enhancing softness of tissue paper generally adversely affect tensile strength. Tissue paper product design is, therefore, generally, an exercise in balancing softness against tensile strength.

Both mechanical and chemical means have been introduced in the pursuit of making soft tissue paper: tissue paper which is perceived by users, through their tactile sense, to be soft. A well known mechanical method of increasing tensile strength of paper made from cellulosic pulp is by mechanically refining the pulp prior to papermaking. In general, greater refining results in greater tensile strength. However, consistent with the foregoing discussion of tissue tensile strength and softness, increased mechanical refining of cellulosic pulp negatively impacts tissue paper softness, all other aspects of the papermaking furnish and process being unchanged.

A variety of chemical treatments have been proposed to increase the tactile sense of softness of tissue paper sheets. For example, it was disclosed in German Patent No. 3,420,940, Kenji Hara et al, to dip, impregnate, or spray dry tissue paper with a combination of a vegetable, animal, or synthetic hydrocarbon oil and a silicone oil such as dimethylsilicone oil. Among other benefits, the silicone oil is said to impart a silky, soft feeling to the tissue paper. This tissue paper, contemplated for toilet paper applications, suffers from disposal complications when flushed through pipe and sewer systems in that the oils are hydrophobic and will cause the tissue paper to float, especially with the passage of time subsequent to treatment with the oils. Another disadvantage is high cost associated with the apparent high levels of the oils contemplated.

It has also been disclosed to treat tissue paper and the furnish used to make tissue paper with certain chemical debonding agents. For example, U.S. Pat. No.3,844,880, Meisel Jr. et al, issued Oct. 29, 1974, teaches that the addition of a chemical debonding agent to the furnish prior to sheet formation leads to a softer sheet of tissue paper. The chemical debonding agents used in the Meisel Jr. et al process are preferably cationic. Other references, e.g., U.S. Pat. No. 4,158,594, Becker et al, issued Jan. 19, 1979 and Armak Company, of Chicago, Ill., in their bulletin 76-17 (1977) have proposed the application of cationic debonders subsequent to sheet formation. Unfortunately, cationic debonders in general have certain disadvantages associated with their use in tissue paper softening applications. In particular, some low molecular weight cationic debonders may cause excessive irritation upon contact with human skin. Higher molecular weight cationic debonders may be more difficult to apply in low levels to tissue paper, and also tend to have undesirable hydrophobic effects upon the tissue paper. Additionally, the cationic debonder treatments of these references tend to decrease tensile strength to such an extent that the use of substantial levels of resins, latex, or other dry strength additives is required to provide commercially acceptable levels of tensile strength. Such dry strength additives add substantial raw materials cost to the tissue paper due to the relatively high level of additive required to provide sufficient dry strength. Furthermore, many dry strength additives have a deleterious affect on tissue softness.

It has now been discovered that treating wet tissue paper webs with a noncationic surfactant results in significant improvement in the tissue paper's tensile/-softness relationship relative to traditional methods of increasing softness. That is, the noncationic surfactant treatment of the present invention greatly enhances tissue softness and any accompanying decrease in tensile strength can be offset by traditional methods of increasing tensile strength such as increased mechanical refining. It has further been discovered that the addition of an effective amount of a binder, such as starch, to the wet tissue web will at least partially offset any reduction in tensile strength and/or increase in linting propensity that results from the noncationic surfactant.

While the present invention relates to improving the softness of paper in general, it pertains in particular to improving the tactile perceivable softness of high bulk, creped tissue paper. Representative high bulk, creped tissue papers which are quite soft by contemporary standards, and which are susceptible to softness enhancement through the present invention are disclosed in the following U.S. Pat. No. 3,301,746, Sanford and Sisson, issued Jan. 31, 1967; U.S. Pat. No. 3,974,025, Ayers, issued Aug. 10, 1976; U.S. Pat. No. 3,994,771 Morgan Jr. et al, issued Nov. 30, 1976; U.S. Pat. No. 4,191,609, Trokhan, issued Mar. 4, 1980 and U.S. Pat. No. 4,637,859, Trokhan; issued Jan. 20, 1987. Each of these papers is characterized by a pattern of dense areas: areas more dense than their respective remainders, such dense areas resulting from being compacted during papermaking as by the crossover knuckles of imprinting carrier fabrics. Other high bulk, soft tissue papers are disclosed in U.S. Pat. No. 4,300,981, Carstens, issued Nov. 17, 1981; and U.S. Pat. No. 4,440,597, Wells et al, issued Apr. 3, 1984. Additionally, achieving high bulk tissue paper through the avoidance of overall compaction prior to final drying is disclosed in U.S. Pat. No. 3,821,068, Shaw, issued Jun. 28, 1974; and avoidance of overall compaction in combination with the use of debonders and elastomeric bonders in the papermaking furnish is disclosed in U.S. Pat. No. 3,812,000, Salvucci Jr., issued May 21, 1974.

It is an object of this invention to provide a process for preparing tissue paper which has an enhanced tactile sense of softness.

It is a further object of this invention to provide a process for preparing tissue paper which has increased tactile softness at a particular level of tensile strength relative to tissue paper which has been softened by conventional techniques.

These and other objects are obtained using the present invention, as will be seen from the following disclosure.

SUMMARY OF THE INVENTION

The present invention encompasses a process for making soft tissue paper. This process includes the steps of wet laying cellulosic fibers to form a web, applying to the web, at a fiber consistency of from about 10% to about 80% (total web weight basis), a sufficient amount of a water-soluble noncationic surfactant such that between about 0.01% and about 2.0% of said noncationic surfactant, dry fiber weight basis, is retained by the tissue paper, and then drying and creping the web. The resulting tissue paper preferably has a basis weight of from about 10 to about 65 g/m$^2$ and a fiber density of less than about 0.6 g/cc.

The noncationic surfactant is applied subsequent to formation of the wet web and prior to drying to completion. Surprisingly, it has been found that noncationic surfactants have high rates of retention when applied to wet tissue paper web in accordance with the process disclosed herein. This is especially unexpected because the noncationic surfactants are applied to the wet webs under conditions wherein they are not ionically substantive to the cellulosic fibers. An important benefit of the noncationic surfactant treatment, applied at the preferred fiber consistency levels and noncationic surfactant levels discussed above, is the high level of tactile softness, at a given tensile strength, relative to conventional methods for increasing softness, such as decreasing the level of mechanical refining. That is, the addition of the noncationic surfactant makes it possible to provide soft tissue paper at the desired tensile strength by, for example, maintaining or increasing the level of mechanical refining.

Noncationic surfactants which are suitable for use in the present invention include anionic, nonionic, ampholytic and zwitterionic surfactants. Preferably, the noncationic surfactant is a nonionic surfactant, with nonionic alkylglycosides being especially preferred. Also, preferably, the surfactant is substantially nonmigratory in situ after the tissue paper has been manufactured in order to substantially obviate post-manufacturing changes in the tissue paper's properties which might otherwise result from the inclusion of surfactant. This may be achieved, for instance, through the use of noncationic surfactants having melt temperatures greater than the temperatures commonly encountered during storage, shipping, merchandising, and use of tissue paper product embodiments of the invention: for example, melt temperatures of about 50° C. or higher.

The process for preparing tissue paper treated with a noncationic surfactant in accordance with the present invention may further comprise the step of adding an effective amount of a binder material such as starch to offset any increase in linting propensity or reduction of tensile strength which would otherwise result from the incorporation of the noncationic surfactant material. Surprisingly, it has been found that surface treatment of tissue paper with a noncationic surfactant and starch mixture results in tissue which is softer for a given tensile strength than tissue which has been treated with noncationic surfactant alone. The effective amount of binder material is such that, preferably, from about 0.01 to about 2 percent, on a dry fiber weight basis, is retained by the tissue paper.

All percentages, ratios and proportions herein are by weight, unless otherwise specified.

The present invention is described in more detail below.

DETAILED DESCRIPTION OF THE INVENTION

Briefly, the present invention provides a process for preparing tissue paper having an enhanced softness through the addition of a noncationic surfactant additive to a wet tissue web. Surprisingly, retention rates of noncationic surfactant applied to wet webs in accordance with the present invention are high even though the noncationic surfactant is applied under conditions wherein it is not ionically substantive to the anionic cellulosic fibers. To ensure high retention rates, the wet web is formed and dewatered prior to application of the noncationic surfactant in order to reduce the loss of noncationic surfactant due to drainage of free water. Importantly, it has been found that greater softness benefits are obtained by addition of the noncationic surfactant to a wet web than through the addition of a noncationic surfactant to a dry web.

Any reduction in tensile strength of the tissue paper resulting from the addition of the noncationic surfactant can be offset by conventional methods of increasing tensile strength such as increased mechanical refining of the pulp, thereby yielding a softer paper at a given tensile strength. Such process may further include the addition of an effective amount of a binder material such as starch to the wet tissue web to offset any exacerbation of linting propensity and/or reduction of tissue paper tensile strength which may be precipitated by the addition of the noncationic surfactant. Surprisingly, the combination of surfactant and starch treatments has been found to provide greater softness benefits for a given tensile strength level than the softness benefits obtained by treatment with the noncationic surfactant alone. This is totally unexpected because the isolated effect of the binder treatment is to increase strength and consequently decrease softness of the tissue paper.

The present invention is applicable to tissue paper in general, including but not limited to conventionally felt-pressed tissue paper; pattern densified tissue paper such as exemplified by Sanford-Sisson and its progeny; and high bulk, uncompacted tissue paper such as exemplified by Salvucci. The tissue paper may be of a homogenous or multilayered construction; and tissue paper products made therefrom may be of a single-ply or multi-ply construction. The tissue paper preferably has a basis weight of between about 10 g/m$^2$ and about 65 g/m$^2$, and density of about 0.60 g/cc or less. Preferably, basis weight will be below about 35 g/m$^2$ or less; and density will be about 0.30 g/cc or less. Most preferably, density will be between 0.04 g/cc and about 0.20 g/cc.

Conventionally pressed tissue paper and methods for making such paper are known in the art. Such paper is typically made by depositing papermaking furnish on a foraminous forming wire. This forming wire is often referred to in the art as a Fourdrinier wire. Once the furnish is deposited on the forming wire, it is referred to as a web. The web is dewatered by pressing the web and dried at elevated temperature. The particular techniques and typical equipment for making webs according to the process just described are well known to those skilled in the art. In a typical process, a low consistency pulp furnish is provided in a pressurized headbox. The headbox has an opening for delivering a thin deposit of pulp furnish onto the Fourdrinier wire to form a wet web. The web is then typically dewatered to a fiber consistency of between about 7% and about 25% (total web weight basis) by vacuum dewatering and further drying by pressing operations wherein the web is subjected to pressure developed by opposing mechanical members, for example, cylindrical rolls. The dewatered web is then further pressed and dried by a stream drum apparatus known in the art as a Yankee dryer. Pressure can be developed at the Yankee dryer by mechanical means such as an opposing cylindrical drum pressing against the web. Multiple Yankee dryer drums may be employed, whereby additional pressing is optionally incurred between the drums. The tissue paper structures which are formed are referred to hereinafter as conventional, pressed, tissue paper structures. Such sheets are considered to be compacted since the web is subjected to substantial mechanical compressional forces while the fibers are moist and are then dried while in a compressed state.

Pattern densified tissue paper is characterized by having a relatively high bulk field of relatively low fiber density and an array of densified zones of relatively high fiber density. The high bulk field is alternatively characterized as a field of pillow regions. The densified zones are alternatively referred to as knuckle regions. The densified zones may be discretely spaced within the high bulk field or may be interconnected, either fully or partially, within the high bulk field. Preferred processes for making pattern densified tissue webs are disclosed in U.S. Pat. No. 3,301,746, issued to Sanford and Sisson on Jan. 31, 1967, U.S. Pat. No. 3,974,025, issued to Peter G. Ayres on Aug. 10, 1976, and U.S. Pat. No. 4,191,609, issued to Paul D. Trokhan on Mar. 4, 1980; all of which are incorporated herein by reference.

In general, pattern densified webs are preferably prepared by depositing a papermaking furnish on a foraminous forming wire such as a Fourdrinier wire to form a wet web and then juxtaposing the web against an array of supports. The web is pressed against the array of supports, thereby resulting in densified zones in the web at the locations geographically corresponding to the points of contact between the array of supports and the wet web. The remainder of the web not compressed during this operation is referred to as the high bulk field. Formation of the densified zones may be accomplished by application of fluid pressure, such as with a vacuum type device or a blow-through dryer, or by mechanically pressing the web against the array of supports. The web is dewatered, and optionally predried, in such a manner so as to substantially avoid compression of the high bulk field. This is preferably accomplished by fluid pressure, such as with a vacuum type device or blow-through dryer, or alternately by mechanically pressing the web against an array of supports wherein the high bulk field is not compressed. The operations of dewatering, optional predrying and formation of the densified zones may be integrated or partially integrated to reduce the total number of processing steps performed. Subsequent to formation of the densified zones, dewatering, and optional predrying, the web is dried to completion, preferably still avoiding mechanical pressing. Preferably, from about 1% to about 14% of the tissue paper surface comprises densified knuckles having a relative density of at least 70% of the density of the high bulk field.

The array of supports is preferably an imprinting carrier fabric having a patterned displacement of knuckles which operate as the array of supports which facilitate the formation of the densified zones upon application of pressure. The pattern of knuckles constitutes the array of supports previously referred to. Imprinting carrier fabrics are disclosed in U.S. Pat. No. 3,301,746, Sanford and Sisson, issued Jan. 31, 1967, U.S. Pat. No. 3,821,068, Salvucci, Jr. et al., issued May 21, 1974, U.S. Pat. No. 3,974,025, Ayers, issued Aug. 10, 1976, U.S. Pat. No. 3,573,164, Friedberg et al. issued Mar. 30, 1971 and U.S. Pat. No. 3,473,576, Amneus, issued Oct. 21, 1969, all of which are incorporated herein by reference.

Preferably, the furnish is first formed into a wet web on a foraminous forming carrier, such as a Fourdrinier wire. The web is dewatered and transferred to an imprinting fabric. The furnish may alternately be initially deposited on a foraminous supporting carrier which also operates as an imprinting fabric. Once formed, the wet web is dewatered and, preferably, thermally predried to a selected fiber consistency of between about 40% and about 80%. Dewatering is preferably performed with suction boxes or other vacuum devices or with blow-through dryers. The knuckle imprint of the imprinting fabric is impressed in the web as discussed above, prior to drying the web to completion. One method for accomplishing this is through application of mechanical pressure. This can be done, for example, by pressing a nip roll which supports the imprinting fabric against the face of a drying drum, such as a Yankee dryer, wherein the web is disposed between the nip roll and drying drum. Also, preferably, the web is molded against the imprinting fabric prior to completion of drying by application of fluid pressure with a vacuum device such as a suction box, or with a blow-through dryer. Fluid pressure may be applied to induce impression of densified zones during initial dewatering, in a separate, subsequent process stage, or a combination thereof.

Uncompacted, nonpattern-densified tissue paper structures are described in U.S. Pat. No. 3,812,000 issued to Joseph L. Salvucci, Jr. and Peter N. Yiannos on May 21, 1974 and U.S. Pat. No. 4,208,459 issued to Henry E. Becker, Albert L. McConnell, and Richard Schutte on Jun. 17, 1980, both of which are incorporated herein by reference. In general, uncompacted, nonpattern-densified tissue paper structures are prepared by depositing a papermaking furnish on a foraminous forming wire such as a Fourdrinier wire to form a wet web, draining the web and removing additional water without mechanical compression until the web has a fiber consistency of at least 80%, and creping the web. Water is removed from the web by vacuum dewatering and thermal drying. The resulting structure is a soft but weak high bulk sheet of relatively uncompacted fibers. Bonding material is preferably applied to portions of the web prior to creping.

The papermaking fibers utilized for the present invention will normally include fibers derived from wood pulp. Other cellulosic fibrous pulp fibers, such as cotton linters, bagasse, etc., can be utilized and are intended to be within the scope of this invention. Synthetic fibers, such as rayon, polyethylene and polypropylene fibers, may also be utilized in combination with natural cellulosic fibers. One exemplary polyethylene fiber which may be utilized is Pulpex TM, available from Hercules, Inc. (Wilmington, Del.)

Applicable wood pulps include chemical pulps, such as Kraft, sulfite and sulfate pulps, as well as mechanical pulps, including, for example, groundwood, thermomechanical pulp and chemically modified thermomechanical pulp. Chemical pulps, however, are preferred since they impart a superior tactile sense of softness to tissue sheets made therefrom. Pulps derived from both deciduous trees (hereinafter, also referred to as "hardwood") and coniferous trees (hereinafter, also referred to as "softwood") may be utilized.

In addition to papermaking fibers, the papermaking furnish used to make tissue paper structures may have other components or materials added thereto as may be or later become known in the art. The types of additives desirable will be dependent upon the particular end use of the tissue sheet contemplated. For example, in products such as toilet paper, paper towels, facial tissues and other similar products, high wet strength is a desirable attribute. Thus, it is often desirable to add to the papermaking furnish chemical substances known in the art as "wet strength" resins.

A general dissertation on the types of wet strength resins utilized in the paper art can be found in TAPPI monograph series No. 29, Wet Strength in Paper and Paperboard, Technical Association of the Pulp and Paper Industry (New York, 1965). The most useful wet strength resins have generally been cationic in character. Polyamide-epichlorohydrin resins are cationic wet strength resins which have been found to be of particular utility. Suitable types of such resins are described in U.S. Pat. No. 3,700,623, issued on Oct. 24, 1972 and U.S. Pat. No. 3,772,076, issued on Nov. 13, 1973, both issued to Keim and both being hereby incorporated by reference. One commercial source of a useful polyamide-epichlorohydrin resins is Hercules, Inc. of Wilmington, Del., which markets such resin under the mark Kymeme TM 557H.

Polyacrylamide resins have also been found to be of utility as wet strength resins. These resins are described in U.S. Pat. No. 3,556,932, issued on Jan. 19, 1971 to Coscia, et al. and U.S. Pat. No. 3,556,933, issued on Jan. 19, 1971 to Williams, et al., both patents being incorporated herein by reference. One commercial source of polyacrylamide resins is American Cyanamid Co. of Stanford, Conn., which markets one such resin under the mark Parez TM 631 NC.

Still other water-soluble cationic resins finding utility in this invention are urea formaldehyde and melamine formaldehyde resins. The more common functional groups of these polyfunctional resins are nitrogen containing groups such as amino groups and methylol groups attached to nitrogen. Polyethylenimine type resins may also find utility in the present invention. It is to be understood that the addition of chemical compounds such as the wet strength resins discussed above to the pulp furnish is optional and is not necessary for the practice of the present development.

Types of noncationic surfactants which are suitable for use in the present invention include anionic, nonionic, ampholytic, and zwitterionic surfactants. Mixtures of these surfactants can also be used. As used herein the term noncationic surfactants shall include all of such types of surfactants. The preferred noncationic surfactants are anionic and nonionic surfactants, with nonionic surfactants being most preferred. The noncationic surfactants preferably have alkyl chains containing eight or more carbon atoms.

A. Nonionic Surfactants

Suitable nonionic surfactants are generally disclosed in U.S. Pat. No. 3,929,678, Laughlin et al., issued Dec. 30, 1975, at column 13, line 14 through column 16, line 6, incorporated herein by reference. Classes of useful nonionic surfactants include:

1. The condensation products of alkyl phenols with ethylene oxide. These compounds include the condensation products of alkyl phenols having an alkyl group containing from about 8 to about 12 carbon atoms in either a straight chain or branched chain configuration with ethylene oxide, the ethylene oxide being present in an amount equal to from about 5 to about 25 moles of ethylene oxide per mole of alkyl phenol. Examples of compounds of this type include nonyl phenol condensed with about 9.5 moles of ethylene oxide per mole of phenol; dodecyl phenol condensed with about 12 moles of ethylene oxide per mole of phenol; dinonyl phenol condensed with about 15 moles of ethylene oxide per mole of phenol; and diisooctyl phenol condensed with about 15 moles of ethylene oxide per mole of phenol. commercially available nonionic surfactants of this type include Igepal CO-630, marketed by the GAF Corporation; and Triton X-45, X-114, X-100, and X-102, all marketed by the Rohm & Haas Company.

2. The condensation products of aliphatic alcohols with from about 1 to about 25 moles of ethylene oxide. The alkyl chain of the aliphatic alcohol can either be straight or branched, primary or secondary, and generally contains from about 8 to about 22 carbon atoms. Particularly preferred are the condensation products of alcohols having an alkyl group containing from about 10 to about 20 carbon atoms with from about 4 to abut 10 moles of ethylene oxide per mole of alcohol. Examples of such ethoxylated alcohols include the condensation product of myristyl alcohol with about 10 moles of ethylene oxide per mole of alcohol; and the condensation product of coconut alcohol (a mixture of fatty alcohols with alkyl chains varying in length from 10 to 14 carbon atoms) with about 9 moles of ethylene oxide. Examples of commercially available nonionic surfactants of this type include Tergitol 15-S-9 (the condensation product of $C_{11}$–$C_{15}$ linear alcohol with 9 moles ethylene oxide), marketed by Union Carbide Corporation; Neodol 45-9 (the condensation product of $C_{14}$ 14 $C_{15}$ linear alcohol with 9 moles of ethylene oxide), Neodol 23-6.5 (the condensation product of $C_{12}$ –$C_{13}$ linear alcohol with 6.5 moles of ethylene oxide), Neodol 45-7 (the condensation product of $C_{14}$–$C_{15}$ -C15 linear alcohol with 7 moles of ethylene oxide), Neodol 45-4 (the condensation product of $C_{14}$14 $C_{15}$ linear alcohol with 4 moles of ethylene oxide), marketed by Shell Chemical Company, and Kyro EOB (the condensation product of $C_{13}$ –$C_{15}$ linear alcohol with 9 moles ethylene oxide), marketed by The Procter & Gamble Company.

3. The condensation products of ethylene oxide with a hydrophobic base formed by the condensation of propylene oxide with propylene glycol. The hydrophobic portion of these compounds has a molecular weight of from about 1500 to about 1800 and exhibits water insolubility. The addition of polyoxyethylene moieties to this hydrophobic portion tends to increase the water solubility of the molecule as a whole, and the liquid character of the product is retained up to the point where the polyoxyethylene content is about 50% of the total weight of the condensation product, which corresponds to condensation with up to about 40 moles of ethylene oxide. Examples of compounds of this type include certain of the commercially available Pluronic surfactants, marketed by Wyandotte Chemical Corporation.

4. The condensation products of ethylene oxide with the product resulting from the reaction of propylene oxide and ethylenediamine. The hydrophobic moiety of these products consists of the reaction product of ethylenediamine and excess propylene oxide, and generally has a molecular weight of from about 2500 to about 3000. This hydrophobic moiety is condensed with ethylene oxide to the extent that the condensation product contains from about 40% to about 80% by weight of polyoxyethylene and has a molecular weight of from about 5,000 to about 11,000. Examples of this type of nonionic surfactant include certain of the commercially available Tetronic compounds, marketed by Wyandotte Chemical Corporation.

5. Semi-polar nonionic surfactants, which include water-soluble amine oxides containing one alkyl moiety of from about 10 to about 18 carbon atoms and 2 moieties selected from the group consisting of alkyl groups and hydroxyalkyl groups containing from about 1 to about 3 carbon atoms; water-soluble phosphine oxides containing one alkyl moiety of from about 10 to about 18 carbon atoms and 2 moieties selected from the group consisting of alkyl groups and hydroxyalkyl groups containing from about 1 to about 3 carbon atoms; and water-soluble sulfoxides containing one alkyl moiety of from about 10 to 18 carbon atoms and a moiety selected from the group consisting of alkyl and hydroxyalkyl moieties of from about 1 to 3 carbon atoms.

Preferred semi-polar nonionic surfactants are the amine oxide surfactants having the formula $$R^3(OH^4)_xNR^5_2 \rightarrow O$$

wherein $R^3$ is an alkyl, hydroxyalkyl, or alkyl phenyl group or mixtures thereof containing from about 8 to about 22 carbon atoms; $R^4$ is an alkylene or hydroxyalkylene group containing from about 2 to about 3 carbon atoms or mixtures thereof; x is from 0 to about 3; and each $R^5$ is an alkyl or hydroxyalkyl group containing from about 1 to about 3 carbon atoms or a polyethylene oxide group containing from about 1 to about 3 ethylene oxide groups. The $R^5$ groups can be attached to each other, e.g., through an oxygen or nitrogen atom, to form a ring structure.

Preferred amine oxide surfactants are $C_{10}$–$C_{18}$ alkyl dimethyl amine oxides and $C_8$–$C_{12}$ alkoxy ethyl dihydroxy ethyl amine oxides.

6. Alkylpolysaccharides disclosed in U.S. Pat. No. 4,565,647, Llenado, issued Jan. 21, 1986, having a hydrophobic group containing from about 6 to about 30 atoms, preferably from about 10 to about 16 carbon atoms and a polysaccharide, e.g., a polyglycoside, hydrophilic group containing from about 1½ to about 10, preferably from about 1½ to about 3, most preferably from about 1.6 to about 2.7 saccharide units. Any reducing saccharide containing 5 or 6 carbon atoms can be used, e.g., glucose, galactose and galactosyl moieties can be substituted for the glucosyl moieties. (Optionally the hydrophobic group is attached at the 2-, 3-, 4-, etc. positions thus giving a glucose or galactose as opposed to a glucoside or galactoside.) The intersaccharide bonds can be, e.g., between the 1-position of the additional saccharide units and the 2-, 3-, 4-, and/or 6positions on the preceding saccharide units.

Optionally, and less desirably, there can be a polyalkyleneoxide chain joining the hydrophobic moiety and the polysaccharide moiety. The preferred alkyleneoxide is ethylene oxide. Typical hydrophobic groups include alkyl groups, either saturate or unsaturated, branched or unbranched containing from about 8 to about 18, preferably from about 10 to about 16, carbon atoms. Preferably, the alkyl group is a straight chain saturated alkyl group. The alkyl group can contain up to 3 hydroxy groups and/or the polyalkyleneoxide chain can contain up to about 10, preferably less than 5, alkyleneoxide moieties. Suitable alkyl polysaccharides are octyl, nonyldecyl, undecyldodecyl, tridecyl, tetradecyl, pentadecyl, hexadecyl, heptadecyl, and octadecyl, di-, tri-, tetra-, penta-, and hexaglucosides, galactosides, lactosides, glucoses, fructosides, fructoses and/or galactoses. Suitable mixtures include coconut alkyl, di-, tri-, tetra-, and pentaglucosides and tallow alkyl tetra-, penta-, and hexaglucosides.

Alkylpolyglycosides are particularly preferred for use in the present invention. The preferred alkylpolyglycosides have the formula $$R^2O(C_nH_{2n}O)_t(\text{glycosyl})_x$$

wherein $R^2$ is selected from the group consisting of alkyl, alkylphenyl, hydroxyalkyl, hydroxyalkylphenyl, and mixtures thereof in which the alkyl groups contain from about 10 to about 18, preferably from about 12 to about 14, carbon atoms; n is 2 or 3, preferably 2; t is from 0 to about 10, preferably 0; and x is from about 1½to about 10, preferably from about 1½to about 3, most preferably from about 1.6 to about 2.7. The glycosyl is preferably derived from glucose. To prepare these compounds, the alcohol or alkylpolyethoxy alcohol is formed first and then reacted with glucose, or a source of glucose, to form the glucoside (attachment at the 1-position). The additional glycosyl units can then be attached between their 1-position and the preceding glycosyl units 2-, 3-, 4- and/or 6-position, preferably predominately the 2-position.

Commercially available alkylglycosides include alkylglycoside polyesters such as Crodesta TM SL-40 which is available from Croda, Inc. (New York, N.Y.) and alkylglycoside polyethers as described in U.S. Pat. No. 4,011,389, issued to W. K. Langdon, et al, on Mar. 8, 1977. Alkylglycosides are additionally disclosed in U.S. Pat. No. 3,598,865, Lew, issued Aug. 1971; U.S. Pat. No. 3,721,633, Ranauto, issued Mar. 1973; U.S. Pat. No. 3,772,269, Lew, issued Nov. 1973; U.S. Pat. No. 3,640,998, Mansfield et al, issued Feb. 1972; U.S. Pat. No. 3,839,318, Mansfield, issued Oct. 1974; and U.S. Pat. No. 4,223,129, Roth et al., issued in Sept. 1980. All of the above patents are incorporated herein by reference.

7. Fatty acid amide surfactants having the formula $$R^6-\overset{\overset{\displaystyle O}{\|}}{C}-NR^7_2$$

wherein $R^6$ is an alkyl group containing from about 7 to about 21 (preferably from about 9 to about 17) carbon atoms and each $R^7$ is selected from the group consisting of hydrogen, $C_1$–$C_4$ alkyl, $C_1$–$C_4$ hydroxyalkyl, and $-(C_2H_4)_x$ where x varies from about 1 to about 3.

Preferred amides are $C_8$–$C_{20}$ ammonia amides, monoethanolamides, diethanolamides, and isopropanolamides.

B. Anionic Surfactants

Anionic surfactants suitable for use in the present invention are generally disclosed in U.S. Pat. No. 3,929,678, Laughlin et al, issued Dec. 30, 1975, at column 23, line 58 through column 29, line 23, incorporated herein by reference. Classes of useful anionic surfactants include:

1. Ordinary alkali metal soaps, such as the sodium, potassium, ammonium and alkylolammonium salts of higher fatty acids containing from about 8 to about 24 carbon atoms, preferably from about 10 to about 20 carbon atoms. Preferred alkali metal soaps are sodium laurate, sodium stearate, sodium oleate and potassium palmitate.

2. Water-soluble salts, preferably the alkali metal, ammonium and alkylolammonium salts, of organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups.)

Examples of this group of anionic surfactants are the sodium and potassium alkyl sulfates, especially those obtained by sulfating the higher alcohols ($C_8$–$C_{18}$ carbon atoms), such as those produced by reducing the glycerides of tallow or coconut oil; and the sodium and potassium alkylbenzene sulfonates in which the alkyl group contains from about 9 to about 15 carbon atoms, in straight chain or branched chain configuration, e.g., those of the type described in U.S. Pat. No. 2,220,099, Guenther et al, issued Nov. 4, 1940, and U.S. Pat. No. 2,477,383, Lewis, issued Dec. 26, 1946. Especially useful are linear straight chain alkylbenzene sulfonates in which the average number of carbon atoms in the alkyl group is from about 11 to about 13, abbreviated as $C_{11}$–$C_{13}$LAS.

Another group of preferred anionic surfactants of this type are the alkyl polyethoxylate sulfates, particularly those in which the alkyl group contains from about 10 to about 22, preferably from about 12 to about 18 carbon atoms, and wherein the polyethoxylate chain contains from about 1 to about 15 ethoxylate moieties, preferably from about 1 to about 3 ethoxylate moieties.

Other anionic surfactants of this type include sodium alkyl glyceryl ether sulfonates, especially those ethers of higher alcohols derived from tallow and coconut oil; sodium coconut oil fatty acid monoglyceride sulfonates and sulfates; sodium or potassium salts of alkyl phenol ethylene oxide either sulfates containing from about 1 to about 10 units of ethylene oxide per molecule and wherein the alkyl groups contain from about 8 to about 12 carbon atoms; and sodium or potassium salts of alkyl ethylene oxide ether sulfates containing about 1 to about 10 units of ethylene oxide per molecule and wherein the alkyl group contains from about 10 to about 20 carbon atoms.

Also included are water-soluble salts of esters of alpha-sulfonated fatty acids containing from about 6 to about 20 carbon atoms in the fatty acid group and from about 1 to about 10 carbon atoms in the ester group; water-soluble salts of 2-acyloxy-alkane-1-sulfonic acids containing from about 2 to about 9 carbon atoms in the acyl group and from about 9 to about 23 carbon atoms in the alkane moiety: alkyl ether sulfates containing from about 10 to about 20 carbon atoms in the alkyl group and from about 1 to about 30 moles of ethylene oxide; water-soluble salts of olefin sulfonates containing from about 12 to about 24 carbon atoms; and beta-alkyloxy alkane sulfonates containing from about 1 to about 3 carbon atoms in the alkyl group and from about 8 to about 20 carbon atoms in the alkane moiety.

3. Anionic phosphate surfactants.

4. N-alkyl substituted succinamates.

C. Ampholytic Surfactants

Ampholytic surfactants can be broadly described as aliphatic derivatives of secondary or tertiary amines, or aliphatic derivatives of heterocyclic secondary and tertiary amines in which the aliphatic radical can be straight or branched chain and wherein one of the aliphatic substituents contains from about 8 to about 18 carbon atoms and at least one of the aliphatic substituents contains an anionic water-solubilizing group, e.g., carboxy, sulfonate, sulfate. See U.S. Pat. No. 3,929,678, Laughlin et al, issued Dec.30, 1975, column 19, line 38 through column 22, line 48, incorporated herein by reference, for examples of ampholytic surfactants useful herein.

D. Zwitterionic Surfactants

Zwitterionic surfactants can be broadly described as derivatives of secondary and tertiary amines, derivatives of heterocyclic secondary and tertiary amines, or derivatives of quaternary ammonium, quaternary phosphonium or tertiary sulfonium compounds. See U.S. Pat. No. 3,929,678, Laughlin et al, issued Dec. 30, 1975, column 19, line 38 through column 22, line 48, incorporated herein by reference, for examples of zwitterionic surfactants useful herein.

The above listings of exemplary noncationic surfactants are in fact intended to be merely exemplary in nature, and are not meant to limit the scope of the invention. Additional noncationic surfactants useful in the present invention and listings of their commercial sources can be found in McCutcheon's *Detergents and Emulsifiers*, North American Ed. pages 312–317 (1987), incorporated herein by reference.

The noncationic surfactant is applied subsequent to formation of the wet web and prior to drying to completion. It has been found that addition of the noncationic surfactant to the wet end of the paper machine (i.e., the paper furnish) is impractical due to low retention levels of the surfactant and excessive foaming. Therefore, in a typical process, the web is formed and then dewatered prior to noncationic surfactant application in order to reduce the loss of noncationic surfactant due to drainage of free water. The noncationic surfactant is preferably applied to the wet web at a fiber consistency level of between 10% and about 80% (based on the weight of the wet web), more preferably between about 15% and about 35%, in the manufacture of conventionally pressed tissue paper; and to a wet web having a fiber consistency of between about 20% and about 35% in the manufacture of tissue paper in papermaking machines wherein the newly formed web is transferred from a fine mesh Fourdrinier to a relatively coarse imprinting/carrier fabric. This is because it is preferable to make such transfers at sufficiently low fiber consistencies that the fibers have substantial mobility during the transfer; and it is preferred to apply the noncationic surfactant after their mobility has substantially dissipated as water removal progresses through the papermaking machine. Also, addition of the noncationic surfactant at higher fiber consistencies assures greater retention in and on the paper: i.e., less noncationic surfactant is lost in the water being drained from the web to increase its fiber consistency. Surprisingly, retention rates of noncationic surfactant applied to wet webs are high even though the noncationic surfactant is applied under conditions wherein it is not ionically substantive to the anionic cellulosic fibers. Retention rates in excess of about 90% are expected at the preferred fiber consistencies without the utilization of chemical retention aids.

The noncationic surfactant should be applied uniformly to the wet tissue paper web so that substantially the entire sheet benefits from the tactile effect of noncationic surfactant. Applying the noncationic surfactant in continuous and patterned distributions are both within the scope of invention and meet the above criteria.

Methods of uniformly applying the noncationic surfactant to the web include spraying and gravure printing. Spraying, has been found to be economical, and susceptible to accurate control over quantity and distribution of noncationic surfactant, so is most preferred. Preferably, an aqueous mixture containing the noncationic surfactant is sprayed onto the wet tissue web as it courses through the papermaking machine: for example, and not by way of limitation, referring to a papermaking machine of the general configuration disclosed in Sanford-Sisson (referenced hereinbefore), either before the predryer, or after the predryer, depending on the desired fiber consistency level. A less preferred method includes deposition of the noncationic surfactant onto a forming wire or fabric which is then contacted by the tissue web. Equipment suitable for spraying noncationic surfactant containing liquids onto wet webs include external mix, air atomizing nozzles, such as the 2 mm nozzle available from V.I.B. Systems, Inc., Tucker, Georgia. Equipment suitable for printing noncationic surfactant containing liquids onto wet webs includes rotogravure printers.

Preferably, as stated hereinbefore, the noncationic surfactant is substantially nonmigratory in situ after the tissue paper has been manufactured in order to substantially obviate post-manufacturing changes in the tissue paper's properties which might otherwise result from the inclusion of noncationic surfactant. This may be achieved, for instance, through the use of noncationic surfactants having melt temperatures greater than the temperatures commonly encountered during storage, shipping, merchandising, and use of tissue paper product embodiments of the invention: for example, melt temperatures of about 50° C. or higher. Also, the noncationic surfactant is preferably water soluble when applied to the wet web.

It has been found, surprisingly, that greater softness benefits are obtained by addition of the noncationic surfactant to a wet web, as opposed to a dry web. Without being bound by theory, it is believed that addition of the noncationic surfactant to a wet web allows the surfactant to interact with the tissue before the bonding structure has been completely set, resulting in a softer tissue paper. Preferably, soft tissue prepared in accordance with the process of the present invention comprises about 2% or less noncationic surfactant. It is an unexpected benefit of this invention that tissue paper treated with about 2% or less noncationic surfactant can have imparted thereto substantial softness by such a low level of noncationic surfactant.

The level of noncationic surfactant applied to wet tissue webs to provide the aforementioned softness benefit ranges from about 0.01% to about 2% noncationic surfactant retained by the tissue paper, more preferably, from about 0.05% to about 1.0% based on the dry fiber weight of the tissue paper.

Importantly, addition of the preferred levels of noncationic surfactant to wet tissue web, as described above, results in significant improvement in the tissue paper's tensile/softness relationship relative to traditional methods of increasing softness. That is, the noncationic surfactant treatment of the present invention greatly enhances tissue softness, and any accompanying decrease in tensile strength can be offset by traditional methods of increasing tensile strength. Thus, for example, tissue paper may be made with pulp that has been subjected to increased refining levels (which increases strength), and then treated with noncationic surfactant as contemplated herein to reduce dry strength to the same level as an unmodified control. The treated tissue paper would be expected to have a higher level of softness than the control, even though both products are at the same tensile strength.

As stated hereinbefore, it is also desirable to treat noncationic surfactant containing tissue paper with a relatively low level of a binder for lint control and/or to increase tensile strength. As used herein, the term "binder" refers to the various wet and dry strength additives known in the art. Starch has been found to be the preferred binder for use in the present invention. Preferably, the tissue paper is treated with an aqueous solution of starch and, also preferably, the sheet is moist at the time of application. In addition to reducing linting of the finished tissue paper product, low levels of starch also imparts a modest improvement in the tensile strength of tissue paper without imparting boardiness (i.e., stiffness) which would result from additions of high levels of starch. Also, this provides tissue paper having improved strength/softness relationship compared to tissue paper which has been strengthened by traditional methods of increasing tensile strength: for example, sheets having increased tensile strength due to increased refining of the pulp; or through the addition of other dry strength additives. Surprisingly, it has been found that the combination of noncationic surfactant and starch treatments results in greater softness benefits for a given tensile strength level than the softness benefits obtained by treating tissue paper with a noncationic surfactant alone. This result is especially surprising since starch has traditionally been used to build strength at the expense of softness in applications wherein softness is not an important characteristic: for example, paperboard. Additionally, parenthetically, starch has been used as a filler for printing and writing paper to improve surface printability.

In general, suitable starch for practicing the present invention is characterized by water solubility, and hydrophilicity. Exemplary starch materials include corn starch and potato starch, albeit it is not intended to thereby limit the scope of suitable starch materials; and waxy corn starch that is known industrially as amioca starch is particularly preferred. Amioca starch differs from common corn starch in that it is entirely amylopectin, whereas common corn starch contains both amplopectin and amylose. Various unique characteristics of amioca starch are further described in "Amioca - The Starch From Waxy Corn", H. H. Schopmeyer, Food Industries, Dec. 1945, pp. 106–108 (Vol. pp. 1476–1478).

The starch can be in granular or dispersed form, albeit granular form is preferred. The starch is preferably sufficiently cooked to induce swelling of the granules. More preferably, the starch granules are swollen, as by cooking, to a point just prior to dispersion of the starch granule. Such highly swollen starch granules shall be referred to as being "fully cooked." The conditions for dispersion in general can vary depending upon the size of the starch granules, the degree of crystallinity of the granules, and the amount of amylose present. Fully cooked amioca starch, for example, can be prepared by heating an aqueous slurry of about 4% consistency of starch granules at about 190 F (about 88° C.) for between about 30 and about 40 minutes.

Other exemplary starch materials which may be used include modified cationic starches such as those modified to have nitrogen containing groups such as amino groups and methylol groups attached to nitrogen, available from National Starch and Chemical Company, (Bridgewater, New Jersey). Such modified starch materials have heretofore been used primarily as a pulp furnish additive to increase wet and/or dry strength. However when applied in accordance with this invention by application to a wet tissue paper web they may have reduced effect on wet strength relative to wet-end addition of the same modified starch materials. Considering that such modified starch materials are more expensive than unmodified starches, the latter have generally been preferred.

The starch should be applied to the tissue paper while the paper is in a moist condition. The starch based material is added to the tissue paper web, preferably when the web has a fiber consistency of about 80% or less. Noncationic starch materials are sufficiently retained in the web to provide an observable effect on softness at a particular strength level relative to increased refining; and, are preferably applied to wet tissue webs having fiber consistencies between about 10% and about 80% (based on the weight of the wet web), more preferably, between about 15% and 35%.

Starch is preferably applied to tissue paper webs in an aqueous solution. Methods of application include, the same previously described with reference to application of noncationic surfactant: preferably by spraying; and, less preferably, by printing. The starch may be applied to the tissue paper web simultaneously with, prior to, or subsequent to the addition of noncationic surfactant.

At least an effective amount of starch to provide lint control and concomitant strength increase upon drying relative to a non-starch treated but otherwise identical sheet is preferably applied to the sheet. Preferably, a sufficient amount of starch is added such that between about 0.01% and about 2.0% of starch is retained in the dried sheet, calculated on a dry fiber weight basis; and, more preferably, between about 0.1% and about 1.0% of starch-based material is retained.

Analysis of the amounts of treatment chemicals herein retained on tissue paper webs can be performed by any method accepted in the applicable art. For example, the level of nonionic surfactants, such as alkylglycosides, retained by the tissue paper can be determined by extraction in an organic solvent followed by gas chromatography to determine the level of surfactant in the extract; the level of anionic surfactants, such as linear alkyl sulfonates, can be determined by water extraction followed by colorimetry analysis of the extract; the level of starch can be determined by amylase digestion of the starch to glucose followed by colorimetry analysis to determine glucose level. These methods are exemplary, and are not meant to exclude other methods which may be useful for determining levels of particular components retained by the tissue paper.

Hydrophilicity of tissue paper refers, in general, to the propensity of the tissue paper to be wetted with water. Hydrophilicity of tissue paper may be somewhat quantified by determining the period of time required for dry tissue paper to become completely wetted with water. This period of time is referred to as "wetting time." In order to provide a consistent and repeatable test for wetting time, the following procedure may be used for wetting time determinations: first, a dry (greater than 90% fiber consistency level) sample unit sheet, approximately $4\frac{3}{8}$ inch $\times 4\frac{3}{4}$ inch (about 11.1 cm $\times$ 12 cm) of tissue paper structure is provided; second, the sheet is folded into four (4) juxtaposed quarters, and then crumpled into a ball approximately 0.75 inches (about 1.9 cm) to about 1 inch (about 2.5 cm) in diameter; third, the balled sheet is placed on the surface of a distilled water at 72° F. (about 22° C.) and a timer is simultaneously started; fourth, the timer is stopped and read when wetting of the balled sheet is completed. Complete wetting is observed visually.

The preferred hydrophilicity of tissue paper depends upon its intended end use. It is desirable for tissue paper used in a variety of applications, e.g., toilet paper, to completely wet in a relatively short period of time to prevent clogging once the toilet is flushed. Preferably, wetting time is 2 minutes or less. More preferably, wetting time is 30 seconds or less. Most preferably, wetting time is 10 seconds or less.

Hydrophilicity characters of tissue paper embodiments of the present invention may, of course, be determined immediately after manufacture. However, substantial increases in hydrophobicity may occur during the first two weeks after the tissue paper is made: i.e., after the paper has aged two (2) weeks following its manufacture. Thus, the above stated wetting times are preferably measured at the end of such two week period. Accordingly, wetting times measured at the end of a two week aging period at room temperature are referred to as "two week wetting times."

The density of tissue paper, as that term is used herein, is the average density calculated as the basis weight of that paper divided by the caliper, with the appropriate unit conversions incorporated therein. Caliper of the tissue paper, as used herein, is the thickness of the paper when subjected to a compressive load of 95 $g/in^2$(15.5 $g/cm^2$).

The following examples illustrate the practice of the present invention but are not intended to be limiting thereof.

EXAMPLE I

The purpose of this example is to illustrate one method that can be used to make soft tissue paper sheets treated with a noncationic surfactant in accordance with the present invention.

A pilot scale Fourdrinier papermaking machine is used in the practice of the present invention. The paper machine has a layered headbox having a top chamber, a center chamber, and a bottom chamber. Where applicable as indicated in the following examples, the procedure described below also applies to such later examples. Briefly, a first fibrous slurry comprised primarily of short papermaking fibers is pumped through the top and bottom headbox chambers and, simultaneously, a second fibrous slurry comprised primarily of long papermaking fibers is pumped through the center headbox chamber and delivered in superposed relation onto the Fourdrinier wire to form thereon a three-layer embryonic web. The level of mechanical refining of the second fibrous slurry (composed of long papermaking fibers) is increased to offset any tensile strength loss due to the noncationic surfactant treatment. The first slurry has a fiber consistency of about 0.11% and its fibrous content is Eucalyptus Hardwood Kraft. The second slurry has a fiber consistency of about 0.15% and its fibrous content is Northern Softwood Kraft. Dewatering occurs through the Fourdrinier wire and is assisted by a deflector and vacuum boxes. The Fourdrinier wire is of a 5-shed, satin weave configuration having 87 machine-direction and 76 cross-machine-direction monofilaments per inch, respectively. The embryonic wet web is transferred from the Fourdrinier wire, at a fiber consistency of about 22% at the point of transfer, to a carrier fabric having a 5-shed satin weave , 35 machine-direction and 33 cross-machine-direction monofilaments per inch, respectively. The non-fabric side of the web is sprayed with an aqueous solution containing a noncationic surfactant, further described below, by a 2 mm spray nozzle located directly opposite a vacuum dewatering box. The wet web has a fiber consistency of about 22% (total web weight basis) when sprayed by the aqueous, noncationic surfactant solution. The sprayed web is carried on the carrier fabric past the vacuum dewatering box, through blow-through predryers after which the web is transferred onto a Yankee dryer. The other process and machine conditions are listed below. The fiber consistency is about 27% after the vacuum dewatering box and, by the action of the predryers, about 65% prior to transfer onto the Yankee dryer; creping adhesive comprising a 0.25% aqueous solution of polyvinyl alcohol is spray applied by applicators; the fiber consistency is increased to an estimated 99% before dry creping the web with a doctor blade. The doctor blade has a bevel angle of about 24 degrees and is positioned with respect to the Yankee dryer to provide an impact angle of about 83 degrees; the Yankee dryer is operated at about 350° F. (177° C.); the Yankee dryer is operated at abut 800 fpm (feet per minute) (about 244 meters per minute). The dry creped web is then passed between two calender rolls. The two calender rolls are biased together at roll weight and operated at surface speeds of 660 fpm (about 201 meters per minute).

The aqueous solution sprayed through the spray nozzle onto the wet web contains Crodesta TM SL-40 an alkyl glycoside polyester nonionic surfactant. The concentration of the nonionic surfactant in the aqueous solution is adjusted until about 0.15%, based upon the weight of the dry fibers, is retained on the web. The volumetric flow rate of the aqueous solution through the nozzle is about 3 gal./hr. cross-direction ft (about 37 liters/hr-meter). The retention rate of the nonionic surfactant applied to the web, in general, is about 90%.

The resulting tissue paper has a basis weight of 30g/m$^2$, a density of 0.10 g/cc, and contains 0.15% by weight, of the alkyl glycoside polyester nonionic surfactant.

The resulting tissue paper is highly wettable and has enhanced tactile softness.

EXAMPLE II

The purpose of this example is to illustrate one method that can be used to make soft tissue paper sheets wherein the tissue paper is treated with noncationic surfactant and starch.

A 3-layer paper sheet is produced in accordance with the hereinbefore described process of Example I. The tissue web is, in addition to being treated with a noncationic surfactant as described above, also treated with fully cooked amioca starch prepared as described in the specification. The starch is applied simultaneously with the noncationic surfactant as part of the aqueous solution sprayed through the papermachine spray nozzle. Concentration of the starch in the aqueous solution is adjusted so that the level of amioca starch retained is about 0.2%, based upon the weight of the dry fibers. The resulting tissue paper has a basis weight of 30g/m$^2$, a density of 0.10g/cc, and contains 0.15% by weight of Crodesta TM SL-40 nonionic surfactant and 0.2% by weight of the cooked amioca starch. Importantly, the resulting tissue paper has enhanced tactile softness and has higher tensile strength and lower propensity for lint than tissue paper treated only with the noncationic surfactant.

What is claimed is:

1. A process for making soft tissue paper, said process comprising the steps of:

(a) wet-laying cellulosic fibers to form a web;

(b) applying to said web, at a fiber consistency of from about 10% to about 80%, total web weight basis, a sufficient amount of a water-soluble noncationic surfactant such that from about 0.01% to about 2.0% of said noncationic surfactant, based on the dry fiber weight of said tissue paper, is retained by said web;

(c) applying to said web, at a fiber consistency of from about 10% to about 80%, total web weight basis, a sufficient amount of a starch binder material such that from about 0.01% to about 2.0% of said starch, based on the dry fiber weight of said tissue paper, is retained by said web; and (d) drying and creping said web;

wherein said tissue paper has a basis weight of from about 10 to about 65 g/m$^2$ and a density of less than about 0.60 g/cc.

2. The process of claim 1, wherein from about 0.05% to about 1.0% of said noncationic surfactant is retained by said web.

3. The process of claim 1 wherein said noncationic surfactant is selected from the group consisting of anionic surfactants, nonionic surfactants, and mixtures thereof.

4. The process of claim 3 wherein said noncationic surfactant is a nonionic surfactant.

5. The process of claim 4 wherein said nonionic surfactant is an alkylglycoside.

6. The process of claim 1 wherein said noncationic surfactant has a melting point of at least about 50° C.

7. The process of claim 1, wherein said noncationic surfactant is applied to said web when said web has a fiber consistency of from about 15% to about 35%.

8. The process of claim 1 wherein from about 0.1 % to about 1.0 % of said starch, based on the dry fiber weight of said tissue paper, is retained by said web.

9. The process of claim 8 wherein said starch is amioca starch.

10. The process of claim 1 wherein said starch is applied to said web when said web has fiber consistency of from about 15 % to about 35 %. said web.

11. The process of claim 12 wherein said noncationic surfactant is an alkylglycoside, said alkylglycoside having a melting point of at least about 50° C.; and wherein said starch is amioca starch.

12. The product made by the process of claim 1.

13. The product made by the process of claim 2.

14. The product made by the process of claim 5.

15. The product made by the process of claim 7.

16. The product made by the process of claim 8.

17. The product made by the process of claim 11.

* * * * *

UNITED STATES PATENT AND TRADEMARK OFFICE

CERTIFICATE OF CORRECTION

PATENT NO. : 4,940,513

DATED : July 10, 1990

INVENTOR(S) : Wolfgang U. Spendel

It is certified that error appears in the above-identified patent and that said Letters Patent is hereby corrected as shown below:

Column 8, line 10, reads "commercially" should read --Commercially--.

Column 8, line 21, reads "abut" should read --about--.

Column 8, line 33, delete "14" (second occurrence) and insert therefor -- - -- (hyphen).

Column 8, line 37, delete "-C15" (second occurrence).

Column 8, line 39, delete "14" (second occurrence) and insert therefor -- - -- (hyphen).

Column 9, line 55, after "6" insert -- - -- (hyphen).

Column 9, line 61, reads "saturate" should read --saturated--.

Column 16, line 9, after "a" insert --body of--.

Column 17, line 33, reads "abut" should read --about--.

Column 18, line 57, delete "said web.".

Signed and Sealed this

Thirty-first Day of December, 1991

*Attest:*

HARRY F. MANBECK, JR.

*Attesting Officer*

*Commissioner of Patents and Trademarks*